US011002411B2

(12) United States Patent
Lin

(10) Patent No.: US 11,002,411 B2
(45) Date of Patent: May 11, 2021

(54) DEVICE FOR STIMULATING DINOFLAGELLATES AND GENERATING A LUMINOUS EFFECT AND PERFORMANCE ROOM

(71) Applicant: JY LIN TRADING CO., LTD., Pingtung County (TW)

(72) Inventor: Yu Ho Lin, Pingtung County (TW)

(73) Assignee: JY LIN TRADING CO., LTD., Pingtung County (TW)

( * ) Notice: Subject to any disclaimer, the term of this patent is extended or adjusted under 35 U.S.C. 154(b) by 351 days.

(21) Appl. No.: 16/039,380

(22) Filed: Jul. 19, 2018

(65) Prior Publication Data

US 2019/0041006 A1 Feb. 7, 2019

(30) Foreign Application Priority Data

Aug. 4, 2017 (TW) ..... 106126412

(51) Int. Cl.

| | |
|---|---|
| ***F21K 2/06*** | (2006.01) |
| ***F21V 33/00*** | (2006.01) |
| ***A63J 5/02*** | (2006.01) |
| ***B67D 3/00*** | (2006.01) |
| ***F21V 23/04*** | (2006.01) |
| ***A63J 17/00*** | (2006.01) |
| ***F21S 10/00*** | (2006.01) |
| ***F21W 131/406*** | (2006.01) |
| ***F21W 131/308*** | (2006.01) |
| ***F21W 121/02*** | (2006.01) |

(52) U.S. Cl.

CPC ..... *F21K 2/06* (2013.01); *A63J 5/02* (2013.01); *A63J 17/00* (2013.01); *B67D 3/0061* (2013.01); *F21S 10/002* (2013.01); *F21V 23/0442* (2013.01); *F21V 33/0056* (2013.01); *F21W 2121/02* (2013.01); *F21W 2131/308* (2013.01); *F21W 2131/406* (2013.01)

(58) Field of Classification Search

CPC ..... F21W 2131/308; F21W 2121/02; F21S 10/002

See application file for complete search history.

(56) References Cited

U.S. PATENT DOCUMENTS 4,294,406 A * 10/1981 Pevnick ..... B05B 17/08 222/422
5,554,035 A * 9/1996 Gooch ..... G09B 23/38 119/245
5,736,969 A * 4/1998 Kuga ..... H04N 13/398 345/6
5,876,995 A * 3/1999 Bryan ..... A23K 50/80 435/189

(Continued)

*Primary Examiner* — Alexander K Garlen
(74) *Attorney, Agent, or Firm* — WPAT, PC

(57) ABSTRACT

A performance room includes: a luminous device for stimulating dinoflagellates and generating a luminous effect; an audio equipment for providing a piece of music, wherein the music is integrated with the luminous effect of the dinoflagellates, and the sequential tonalities and rhythms of the music are related to the switching of switching elements of the luminous device; and a field which can define a performance space, wherein the luminous effect of the dinoflagellates and the music are located in the field of the performance space. In particularly, the luminous effect is exhibited by integrating the musical melody with the dinoflagellates itself acted as a performer.

16 Claims, 12 Drawing Sheets

(56) References Cited

U.S. PATENT DOCUMENTS

| | | | | |
|---|---|---|---|---|
| 6,247,995 | B1 * | 6/2001 | Bryan | A23L 29/06 446/473 |
| 9,223,192 | B1 * | 12/2015 | Linnell | G03B 21/608 |
| 10,478,831 | B1 * | 11/2019 | Soin | B04C 3/00 |
| 2002/0004942 | A1 * | 1/2002 | Bryan | A23G 9/44 800/288 |
| 2010/0028986 | A1 * | 2/2010 | Hanafusa | B01L 3/502738 435/287.2 |
| 2019/0060944 | A1 * | 2/2019 | Fuller | B05B 12/04 |

* cited by examiner

DEVICE FOR STIMULATING DINOFLAGELLATES AND GENERATING A LUMINOUS EFFECT AND PERFORMANCE ROOM

CROSS-REFERENCE TO RELATED APPLICATION

This application claims the benefit of Taiwan Patent Application No. 106126412, filed on Aug. 4, 2017, which is hereby incorporated by reference for all purposes as if fully set forth herein.

BACKGROUND

Technical Field

The present disclosure relates to a luminous device, and particularly to a device for stimulating dinoflagellates and generating a luminous effect and a performance room.

Related Art

A Stage drama is a direct face-to-face activity that attracts viewers to appreciate it, and especially live performances are the most exciting. However, due to the advancement of science and technology, TV dramas have gradually adopted high-quality sound and light effects to shoot, and have suddenly become popular multimedia products. But, dramas shooting production and live performance are two different orientations of performances, and especially the viewers feel that the quasi-simulation and the coherence degree of the movement are great. According to the dramas shooting production, actor number of performance is relatively unconstrained, and it is easy to achieve better visual experience through special effects such as cropping and animation. Thus, the live performance is relatively weaker than the dramas shooting production. However, the live performances have not been eliminated, because this kind of performance can still attract specific groups to watch the live performances. Of course, the popularity of the live performances is not strong enough to keep up with the trend of the times. Therefore, the applicant believes that the reason for the gradual decline in the live performances is that the effects of the scene and performance cannot be compared with the dramas shooting production. If we can gradually improve the effect of the live performances on the spot, the applicant believes that it can again attract a group of people to watch the live performances.

However, traditional live performances are performed by generally using artificial landscaping or artificial performances, and rarely using nature's materials and integrating with acousto-optic effects therewith for performance.

SUMMARY

A main objective of the present disclosure is to provide a device for stimulating dinoflagellates and generating a luminous effect, to enhance the visual effect of live performance of a performance room.

In order to achieve the foregoing objective, the present disclosure provides a performance room including: a luminous device for stimulating dinoflagellates and generating a luminous effect, the luminous effect being located on a specific local region of a water collecting basin; an audio equipment for providing a piece of music, wherein the music is integrated with the luminous predetermined shape (i.e., the luminous effect of the dinoflagellates), and the sequential tonalities and rhythms of the music are related to the switching of switching elements of the luminous device; a sound sensing module adapted for sensing an external sound, wherein the external sound is integrated with the luminous effect of the dinoflagellates, and the sequential tonalities and rhythms of the sound are related to the switching of switching elements of the luminous device; and a field which defines a performance space, wherein the luminous effect of the dinoflagellates, the music and the external sound are located in the field of the performance space.

The technical feature of the present disclosure lies in that: the luminous device disclosed in the present disclosure generates a luminous effect by stimulating dinoflagellates. The luminous effect can be controlled and located on a specific local region of the water collecting basin according to time and order, and the luminous effect can be integrated with the music or the external sound, to enhance the visual effect of live performance of the performance room. In particularly, the luminous effect is exhibited by integrating the musical melody or the external sound with the dinoflagellates (e.g., Noctiluca scintillans) itself acted as a performer.

To make the foregoing and other objectives, features, and advantages of the present disclosure more evident, detailed description is made hereinafter as follows with reference to the accompanying drawings.

DETAILED DESCRIPTION

Figure 1A:
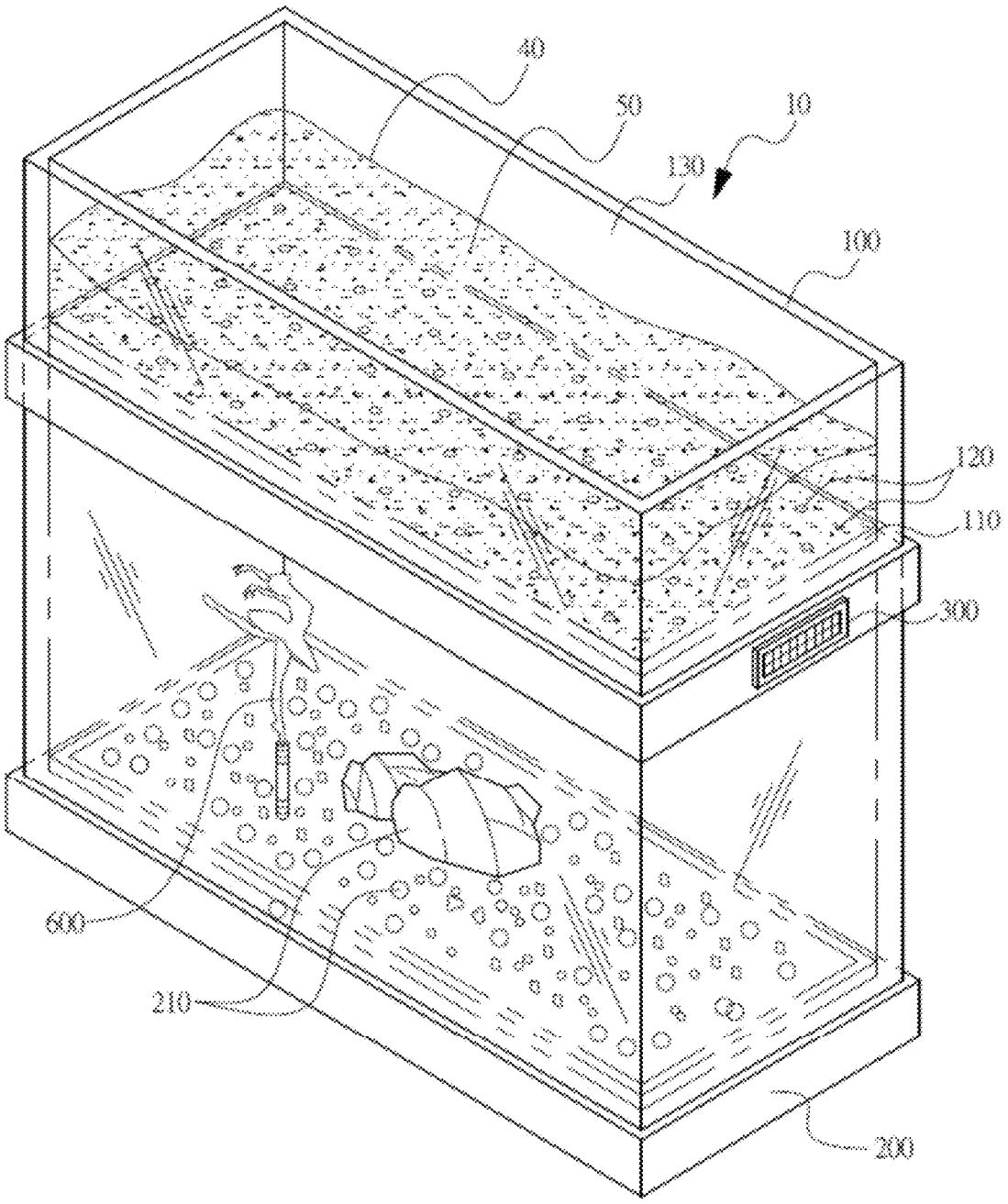
FIG. 1*a* is a perspective schematic view of a device for stimulating dinoflagellates and generating a luminous effect according to the first embodiment of the present disclosure.
Figure 1B:
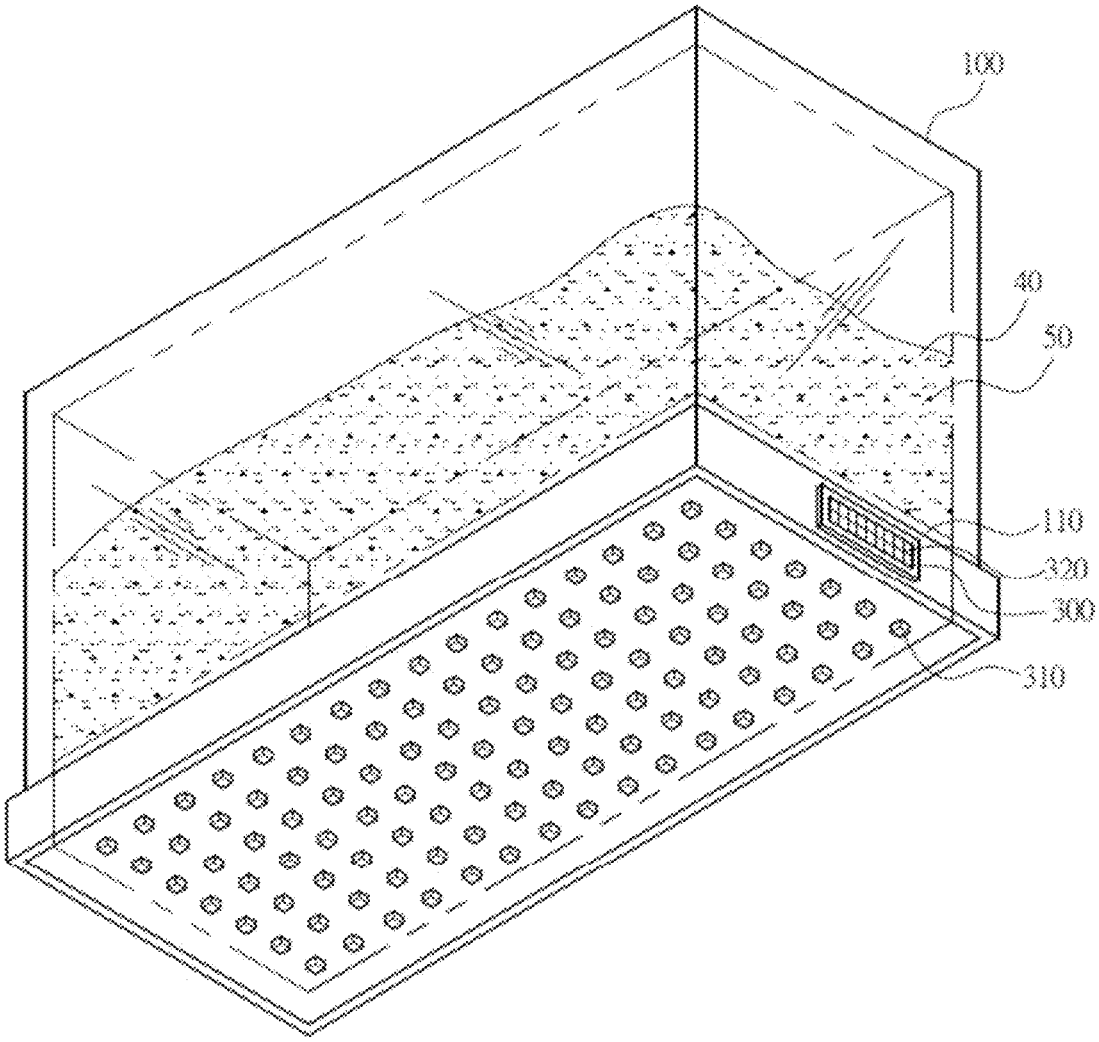
FIG. 1*b* is a perspective schematic view of a water tank according to the first embodiment of the present disclosure.

FIG. 1*a* is a perspective schematic view of a device 10 for stimulating dinoflagellates and generating a luminous effect according to the first embodiment of the present disclosure, and FIG. 1*b* is a perspective schematic view of a water tank 100 according to the first embodiment of the present disclosure. Please referring to FIGS. 1*a* and 1*b*, the device for stimulating dinoflagellates and generating a luminous effect includes: a water tank 100, a first switching unit 300 and a water collecting basin 200 having a predetermined shape 210. The water tank 100 includes a bottom partition plate 110 and an accommodating space 130, wherein the bottom partition plate 110 has a plurality of holes 120, and the holes 120 are communicated with the accommodating space 130. The accommodating space contains dinoflagellates 50 which have not been stimulated yet and seawater 40. For example, the dinoflagellates 50 and the seawater 40 can be transported into the accommodating space 130 by human force (e.g., by means of hand-held water) or mechanical force (e.g., by means of pumping water). The first switching unit 300 includes a plurality of switch elements 310, wherein the switching elements 310 are physically connected to the holes 120 of the bottom partition plate 110 respectively, and are adapted to control the flow rate of the dinoflagellates 50 and the seawater 40 located in the accommodating space 130 of the water tank 100 to flow out through the holes 120 of the bottom partition plate 110. The water collecting basin 200 is arranged below the bottom partition plate 110 of the water tank 100, for example, the water tank 100 can be located above the water collecting basin 200 by supporting multiple transparent glass (or multiple supporting columns). When the dinoflagellates 50 and the seawater 40 flowing out from the holes 120 of the bottom partition plate 110 drop into the predetermined shape 210 of the water collection basin 200, the dinoflagellates 50 is stimulated to generate a luminous effect, the luminous effect being located on a first region of the collection basin 200 (i.e., a specific local region of the collection basin 200), for example, the first region may be a middle area, but is not limited thereto. The predetermined shape 210 of the water collecting basin 200 is exemplified by a sandstone shape. Or, the predetermined shape 210 can also be a flat surface for collecting water. The predetermined shape 210 is not limited thereto.

The dinoflagellates 50 are selected from a Noctiluca scintillans, belonging to single cell organisms in Dinoflagellata, commonly known as Hai Yao, also known as Noctiluca, and also called as blue tears in Taiwan. Noctiluca scintillans are non-parasitic dinoflagellates that live in the sea and can have bioluminescence. This dinoflagellate is able to emit light because thousands of spherical cells in its body have luciferin and luciferase. These spherical cells act like miniature power supplies, allowing the Noctiluca scintillans to emit fluorescent light when the Noctiluca scintillans feel the surrounding environment changes.

The *Noctiluca scintillans* will emit a blue flash when it is agitated from water. The *Noctiluca scintillans* have a luminescence mechanism that depends on the intracellular luciferin and luciferase, and also involve scintillons which exist on the cell membrane and can act as a signal-activated controller. When the *Noctiluca scintillans* are mechanically stimulated, proteins on the cell membrane release the combined luciferin, and the released luciferin reacts with the luciferase and emit blue light having a wavelength of 474 to 476 nm. The *Noctiluca scintillans* are derived from seawater such as Kenting in Taiwan, the Taiwan Strait, and Matsu in outer islands, and they are immediately known as West Linda Mar Bay in California, USA, Maldives, and Gippsland Lake in Victoria, Australia. The type of the above-mentioned dinoflagellates can be algae which are in Dinoflagellata and emit light, not limited to *Noctiluca scintillans*.

Please referring to FIGS. 1*a* and 1*b*, the first switching unit 300 further includes a programmable controller 320 electrically connected to the switch elements 310 for controlling the time and order of the dinoflagellates 50 or seawater 40 in the accommodating space 130 of the water tank 100 to flow out through the holes 120 of the bottom partition plate 110. The switch element 310 can be a solenoid valve or a micro valve (e.g., the micro valve is driven by a piezoelectric actuator).

The holes 120 of the bottom partition plate 110 has different sizes to determine different flow rates.

Figure 2A:
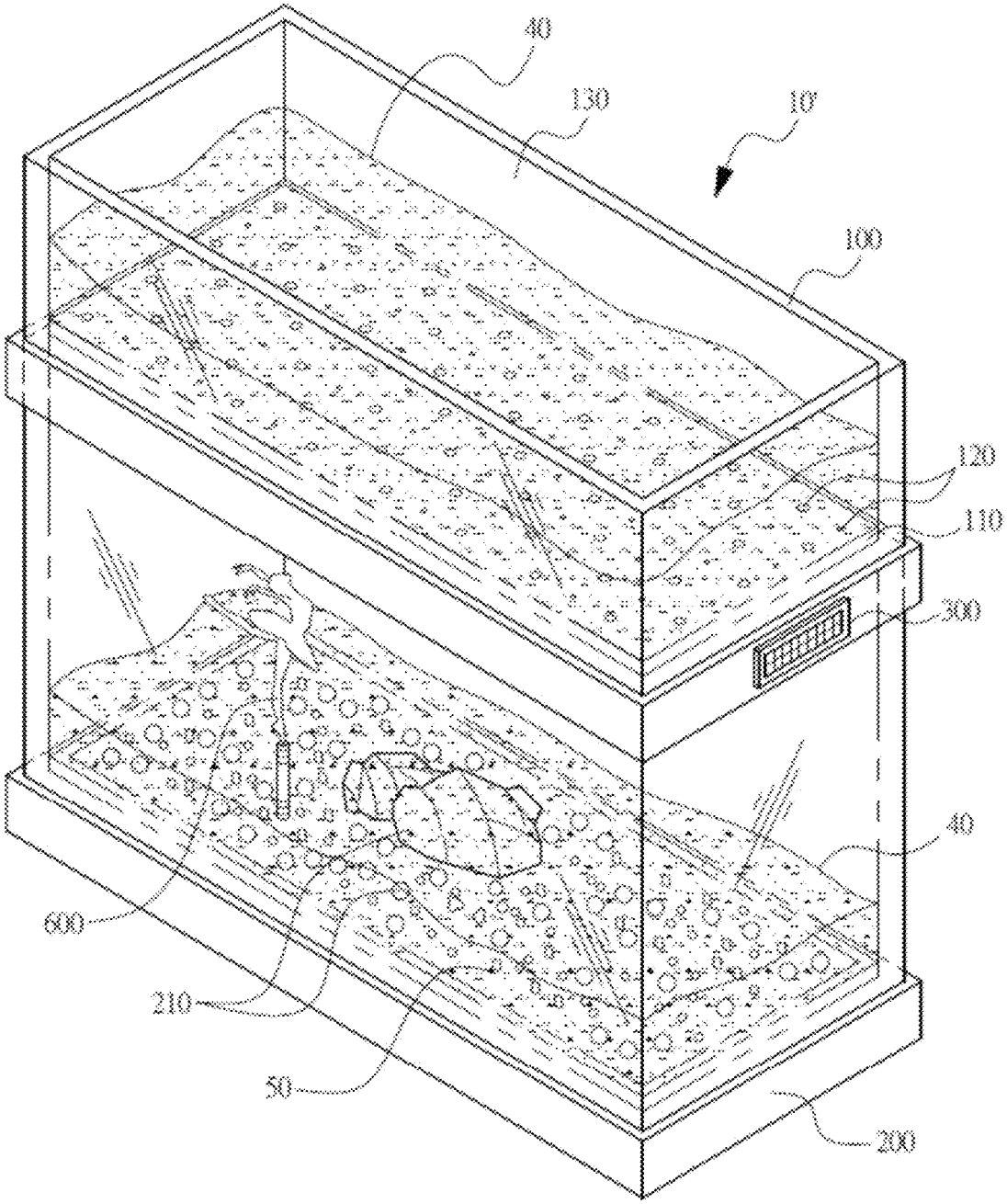
FIG. 2*a* is a perspective schematic view of a device for stimulating dinoflagellates and generating a luminous effect according to the second embodiment of the present disclosure.
Figure 2B:
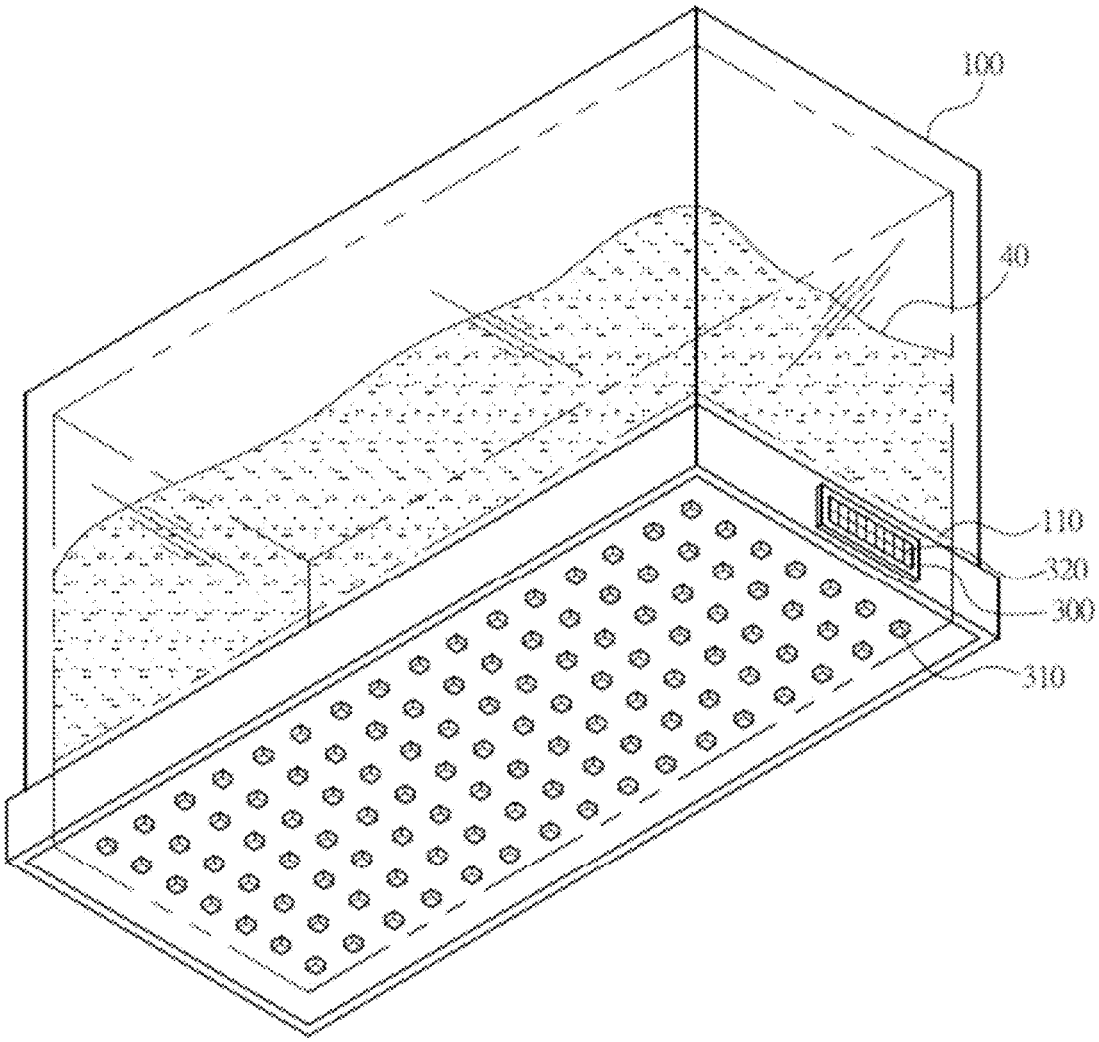
FIG. 2*b* is a perspective schematic view of a water tank according to the first embodiment of the present disclosure.

FIG. 2*a* is a perspective schematic view of a device 10' for stimulating dinoflagellates and generating a luminous effect according to the second embodiment of the present disclosure, and FIG. 2*b* is a perspective schematic view of a water tank 100 according to the second embodiment of the present disclosure. Please referring to FIGS. 1*a* and 2*a*, the device 10' for stimulating dinoflagellates and generating a luminous effect in the second embodiment is similar to the device 10 for stimulating dinoflagellates and generating a luminous effect in the first embodiment, and the same elements have been designated by same reference numbers. The difference between the second and first embodiment is that: the water collecting basin 200 of the device 10' in the second embodiment can contain dinoflagellates 50 which have not been stimulated yet and seawater 40, and the water tank 100 only contain seawater 40 and doesn't contain the dinoflagellates 50 which have not been stimulated yet. The water collecting basin 200 has a predetermined shape 210 and is arranged below the bottom partition plate 110 of the water tank 100, whereby when the seawater 40 flowing out from the holes 120 of the bottom partition plate 110 touches the dinoflagellates 50, the dinoflagellates 50 are stimulated and generating a luminous effect, the luminous effect being located on a first region of the collection basin 200 (i.e., a specific local region of the collection basin 200), for example, the first region may be a middle area, but is not limited thereto.

Please referring to FIGS. 2*a* and 2*b*, in another embodiment, when the seawater 40 flowing out from the holes 120 of the bottom partition plate 110 touches the dinoflagellates 50, the dinoflagellates 50 are stimulated to generate a luminous effect.

In another embodiment, the water collecting basin 200 can contain dinoflagellates 50 which have not been stimulated yet and seawater 40, and the water tank 100 can also contain seawater 40 and the dinoflagellates 50 which have not been stimulated yet. Thus, the luminous effects of the devices 10, 10' (i.e., the device for stimulating dinoflagellates and generating a luminous effect) in the first and second embodiments can be achieved at the same time.

Figure 3A:
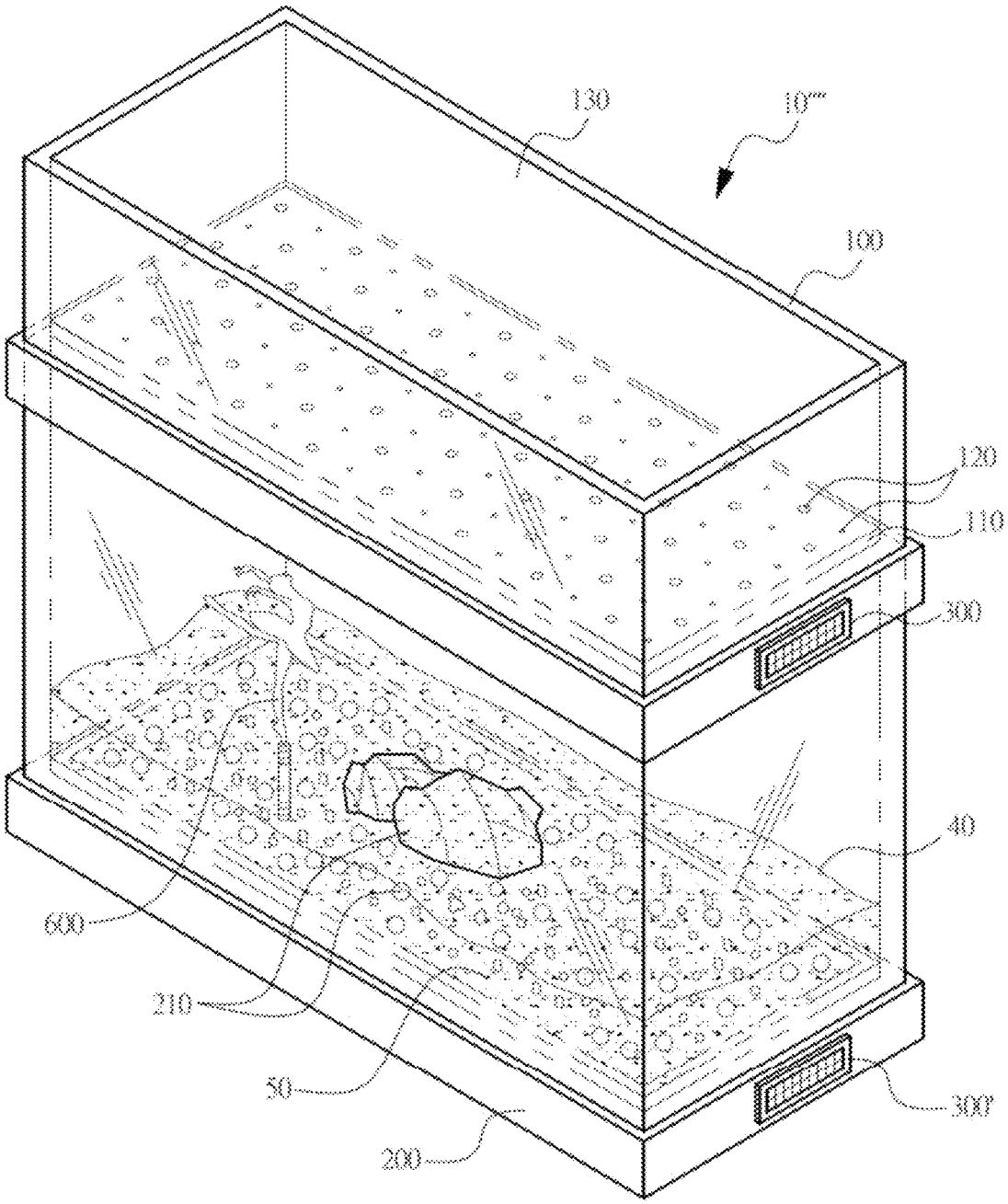
FIG. 3*a* is a perspective schematic view of a device for stimulating dinoflagellates and generating a luminous effect according to the fifth embodiment of the present disclosure.
Figure 3B:
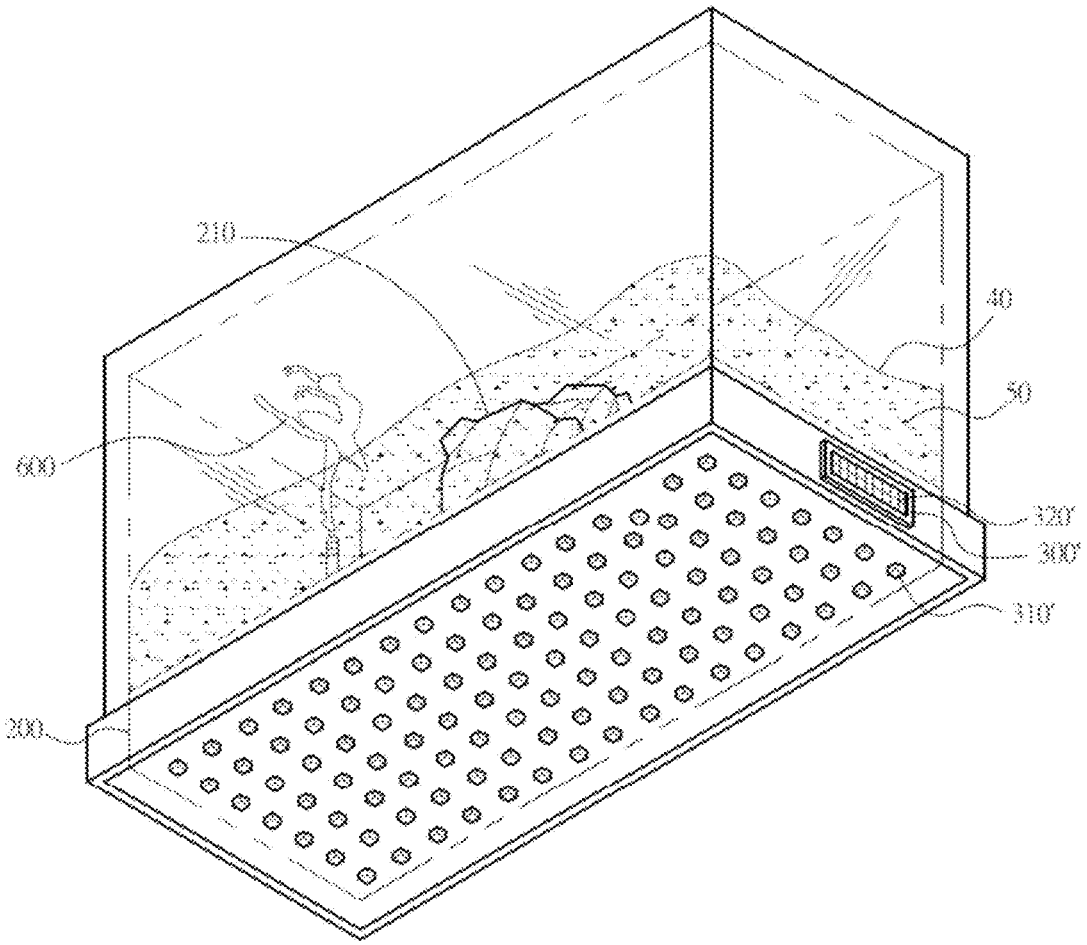
FIG. 3*b* is a perspective schematic view of a water collecting basin according to the fifth embodiment of the present disclosure.

FIG. 3*a* is a perspective schematic view of a device for stimulating dinoflagellates and generating a luminous effect according to the fifth embodiment of the present disclosure, and FIG. 3*b* is a perspective schematic view of a water collecting basin according to the second embodiment of the present disclosure. Please referring to FIGS. 1*a*, 3*a* and 3*b*, the device 10"" for stimulating dinoflagellates and generating a luminous effect in the fifth embodiment is similar to the device 10 for stimulating dinoflagellates and generating a luminous effect in the first embodiment, and the same elements have been designated by same reference numbers. The difference between the fifth and first embodiment is that: the water collecting basin 200 of the device 10"" in the fifth embodiment can contain dinoflagellates 50 which have not been stimulated yet and seawater 40, and the water tank 100 doesn't contain the dinoflagellates 50 which have not been stimulated yet and the seawater 40; and the device 10"" for stimulating dinoflagellates and generating a luminous effect further includes a second switching unit 300'. The second switching unit 300' includes a plurality of switch elements 310', which are respectively disposed on a bottom of the water collecting basin 200 having a predetermined shape 210, thereby controlling the dinoflagellates 50 and the seawater 40 in the water collecting basin 200 to be disturbed to stimulate the dinoflagellates 50 and then to generate a luminous effect, the luminous effect is located on a second region of the water collecting basin 200 (i.e., another specific local region of the collection basin 200), for example, the second region can be a peripheral area, but is not limited thereto. The switch elements 310' can be piezoelectric actuators. Since the switch elements 310' are respectively disposed at the bottom of the water collecting basin 200, the switch elements 310' must be sealed to avoid seawater erosion.

Please referring to FIG. 3*b*, the second switching unit 300' further includes a programmable controller 320' electrically connected to the switch elements 310' for controlling the switch elements 310' to disturb the dinoflagellates 50 which have not been stimulated yet and the seawater 40 in the water collecting basin 200, further to stimulate the dinoflagellates 50 and then to generate a luminous effect.

Figure 4A:
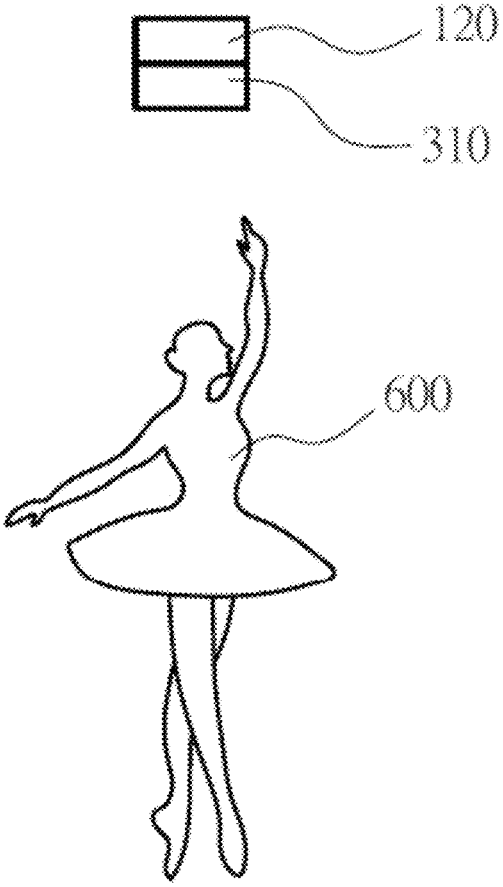
FIG. 4*a* is a schematic view showing before an object is luminous in the device for stimulating dinoflagellates and generating a luminous effect according to an embodiment of the present disclosure.
Figure 4B:
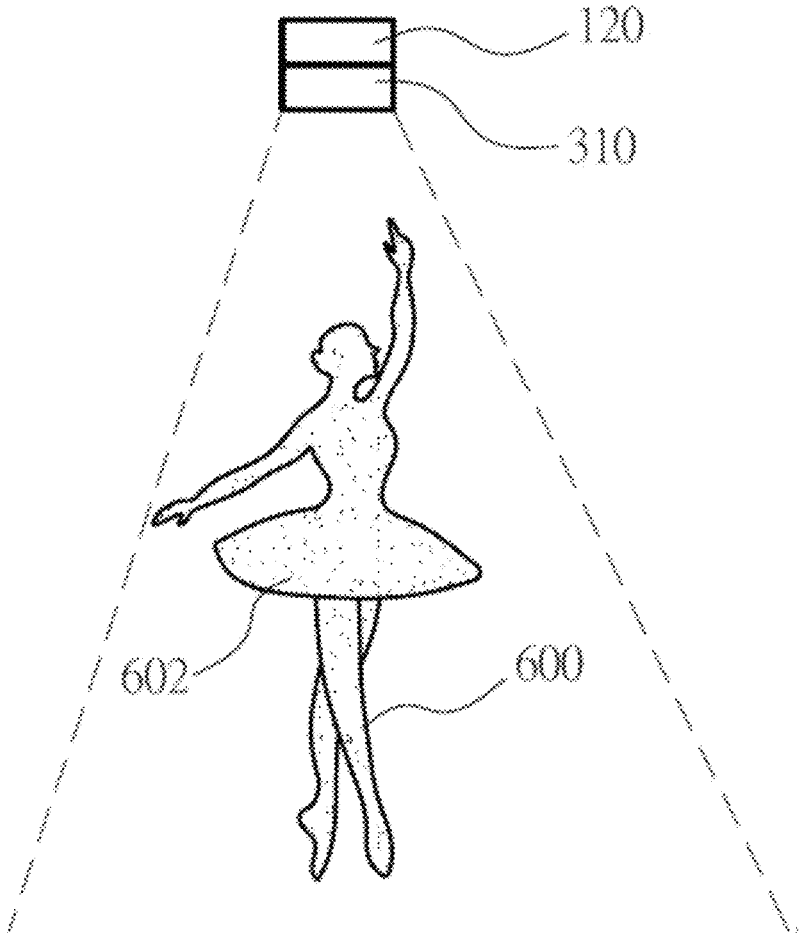
FIG. 4*b* is a schematic view showing after an object is luminous in the device for stimulating dinoflagellates and generating a luminous effect according to an embodiment of the present disclosure.
Figure 4C:
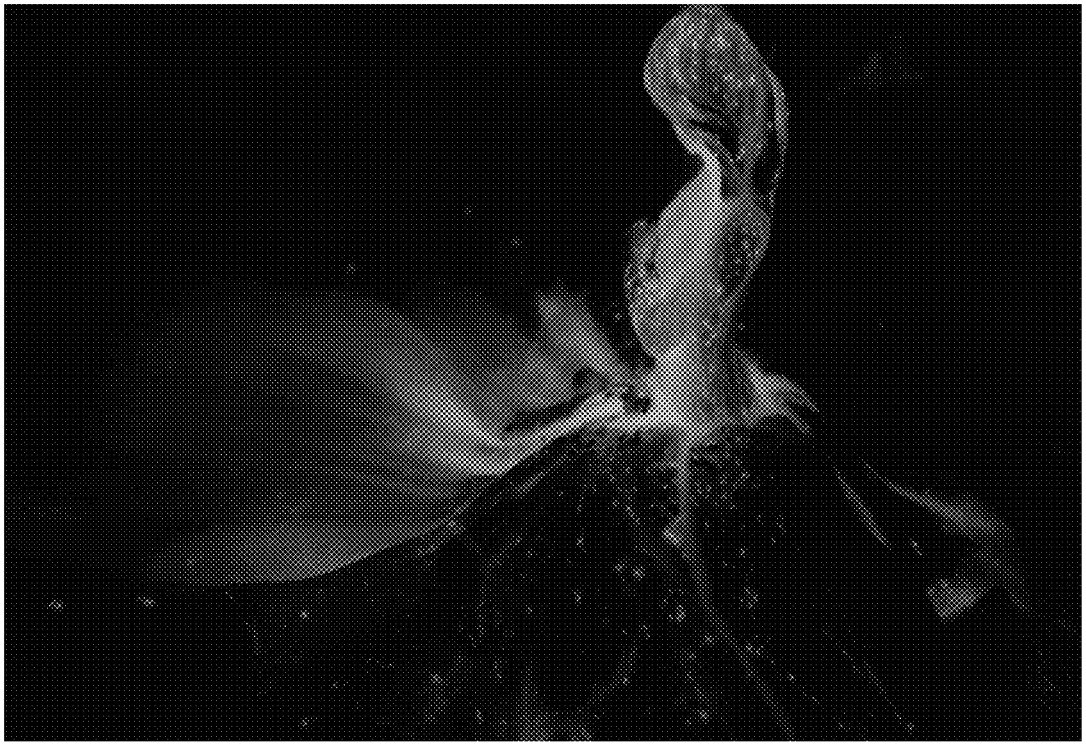
FIG. 4*c* is a schematic view showing a photo of a luminous object in the device for stimulating dinoflagellates and generating a luminous effect according to an embodiment of the present disclosure.

FIG. 4*a* is a schematic view showing before an object 600 is luminous in the device for stimulating dinoflagellates and generating a luminous effect according to an embodiment of the present disclosure, FIG. 4*b* is a schematic view showing after an object 600 is luminous in the device for stimulating dinoflagellates and generating a luminous effect according to an embodiment of the present disclosure, and FIG. 4*c* is a schematic view showing a photo of a luminous object in the device for stimulating dinoflagellates and generating a luminous effect according to an embodiment of the present disclosure. Please referring to FIGS. 1*a*, 4*a*, 4*b* and 4*c*, the switch elements 310 controls the dinoflagellates 50 and the seawater 40 in the accommodating space 130 of the water tank 100 to pass through the holes 120 of the bottom partition plate 110, so that the dinoflagellates 50 touch an object 600. The object 600 can be exemplified by a shape of dancer. When the dinoflagellate 50 is mechanically stimulated by touching the object 600, it causes the protein on the cell membrane to release the combined luciferin, and the released luciferin reacts with the luciferase and emit blue light having a wavelength of 474 to 476 nm. Thus, when the object 600 is covered with the dinoflagellates 50, a luminous effect 602 is generated (for example, a luminous effect as shown in FIGS. 4*b* and 4*c*).

Figure 5:
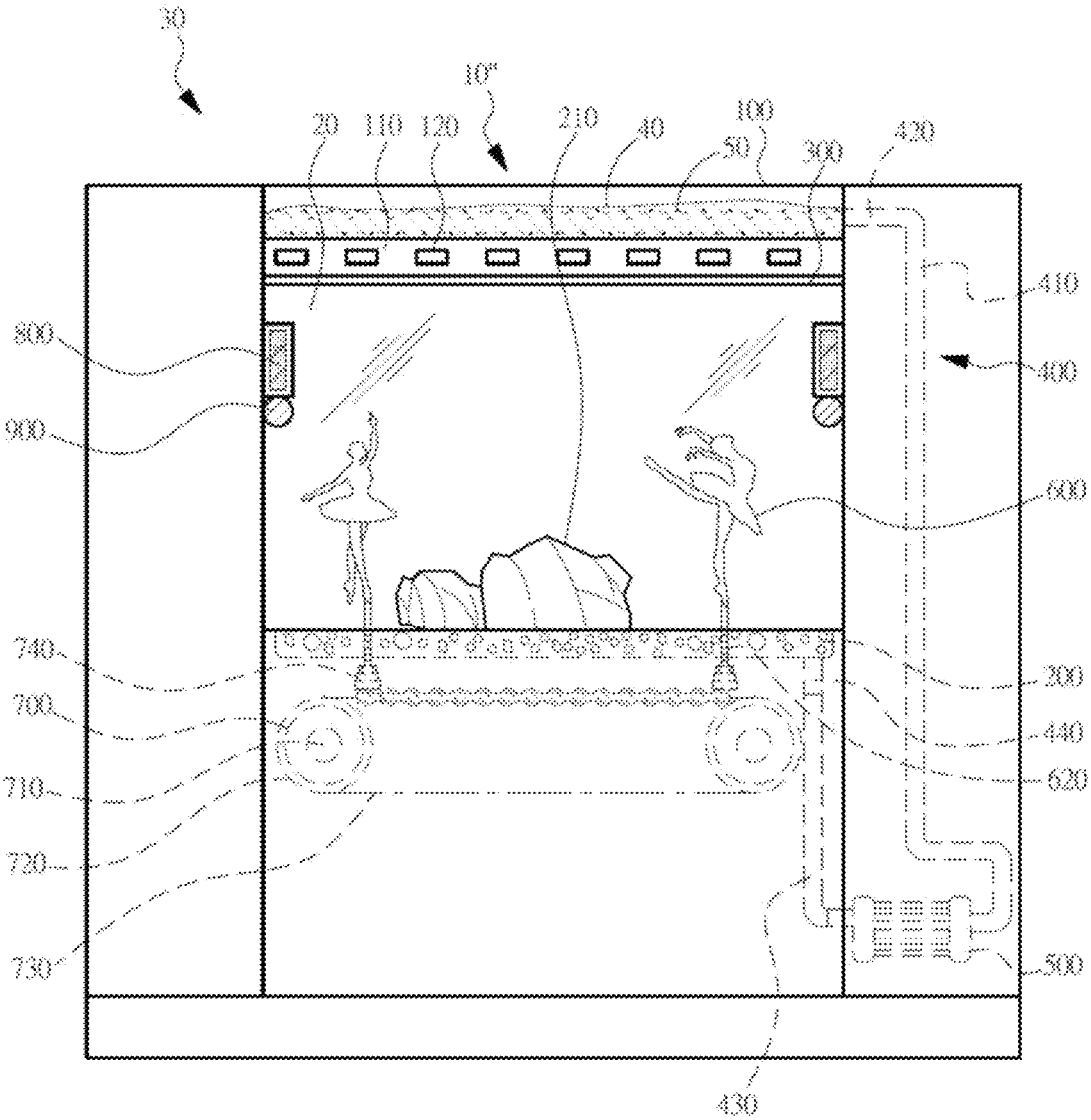
FIG. 5 is a plan schematic view of a performance room according to an embodiment of the present disclosure.

FIG. 5 is a plan schematic view of a performance room 30 according to an embodiment of the present disclosure. Please referring to FIGS. 1*a* and 5, the performance room 30 includes a device 10" for stimulating dinoflagellates and generating a luminous effect according to the third embodiment of the present disclosure. The device 10" for stimulating dinoflagellates and generating a luminous effect in the third embodiment is similar to the device 10 for stimulating dinoflagellates and generating a luminous effect in the first embodiment, and the same elements have been designated by same reference numbers. The difference between the third and first embodiments is that: the device 10" for stimulating dinoflagellates and generating a luminous effect in the third embodiment further includes a water pipe unit 400 and a pump 500. The water pipe unit 400 has an inlet pipe 410 and a drain pipe 430, wherein the inlet pipe 410 is communicated with the water tank 100, and the drain pipe 430 is communicated with the water collecting basin 200. The pump 500 is disposed between the drain pipe 430 and the inlet pipe 410 for transporting the dinoflagellates 50 and the seawater 40 to the water tank 100. In other words, in the third embodiment, the dinoflagellates 50 and the seawater 40 are transported into the accommodating space 130 by mechanical force (i.e., by means of pumping water).

The device 10" for stimulating dinoflagellates and generating a luminous effect in the third embodiment further includes: at least one object 600, which can be located at a fixed position and has specific shape. The object 600 is detachably mounted on the predetermined shape 210 of the water collection basin 200. The predetermined shape 210 of the water collecting basin 200 is exemplified by a shape of sandstone or a shape of dancer, and is not limited thereto.

Alternatively, the object 600 can be a positionally-moving object having a specific shape. The device 10" for stimulating dinoflagellates and generating a luminous effect further includes at least one driving unit 700. The driving unit 700 includes a driving element 710 (e.g. servo motor), a plurality of driving wheels 720 driven by the driving element 710, a flexible chain 730 wound around the driving wheels 720, and at least one fixing seat 740 provided on the flexible chain 730. The driving unit 700 further includes a thread portion 620 which is screwed into a screw hole, the thread portion 620 is mounted on the fixing seat 740, and the object 600 is detachably mounted on the thread portion 620. Thus, the driving unit 700 is adapted to drive the object 600 to move on the predetermined shape 210.

Figure 6:
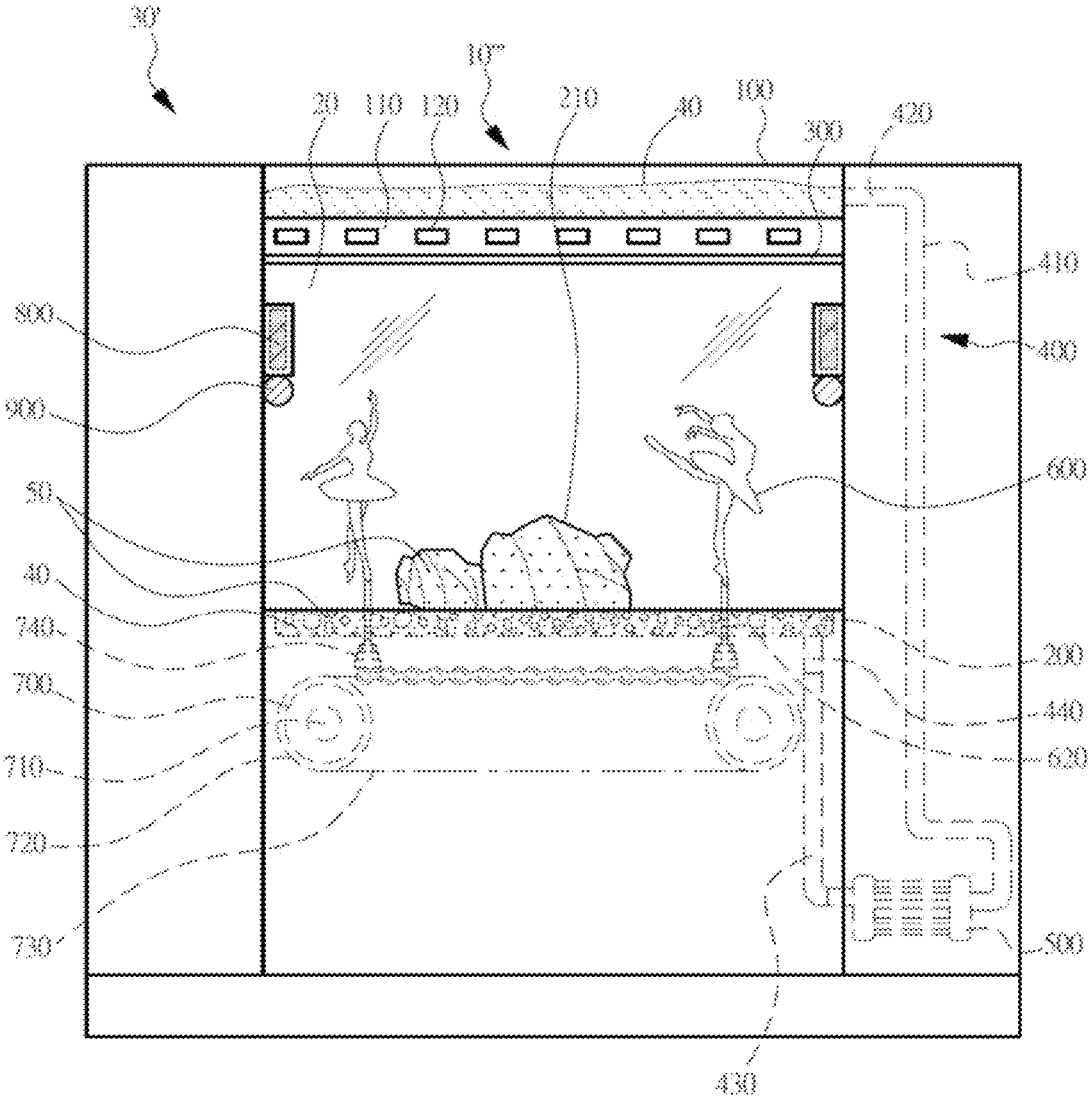
FIG. 6 is a plan schematic view of a performance room according to another embodiment of the present disclosure.

FIG. 6 is a plan schematic view of a performance room 30' according to another embodiment of the present disclosure. Please referring to FIGS. 5 and 6, the performance room 30' includes a device 10''' for stimulating dinoflagellates and generating a luminous effect according to the fourth embodiment of the present disclosure. The device 10''' for stimulating dinoflagellates and generating a luminous effect in the fourth embodiment is similar to the device 10" for stimulating dinoflagellates and generating a luminous effect in the third embodiment, and the same elements have been designated by same reference numbers. The difference between the fourth and third embodiments is that: the water collecting basin 200 of the device 10''' in the fourth embodiment can contain dinoflagellates 50 which have not been stimulated yet and seawater 40, and the water tank 100 only contain seawater 40 and doesn't contain the dinoflagellates 50 which have not been stimulated yet.

Figure 7:
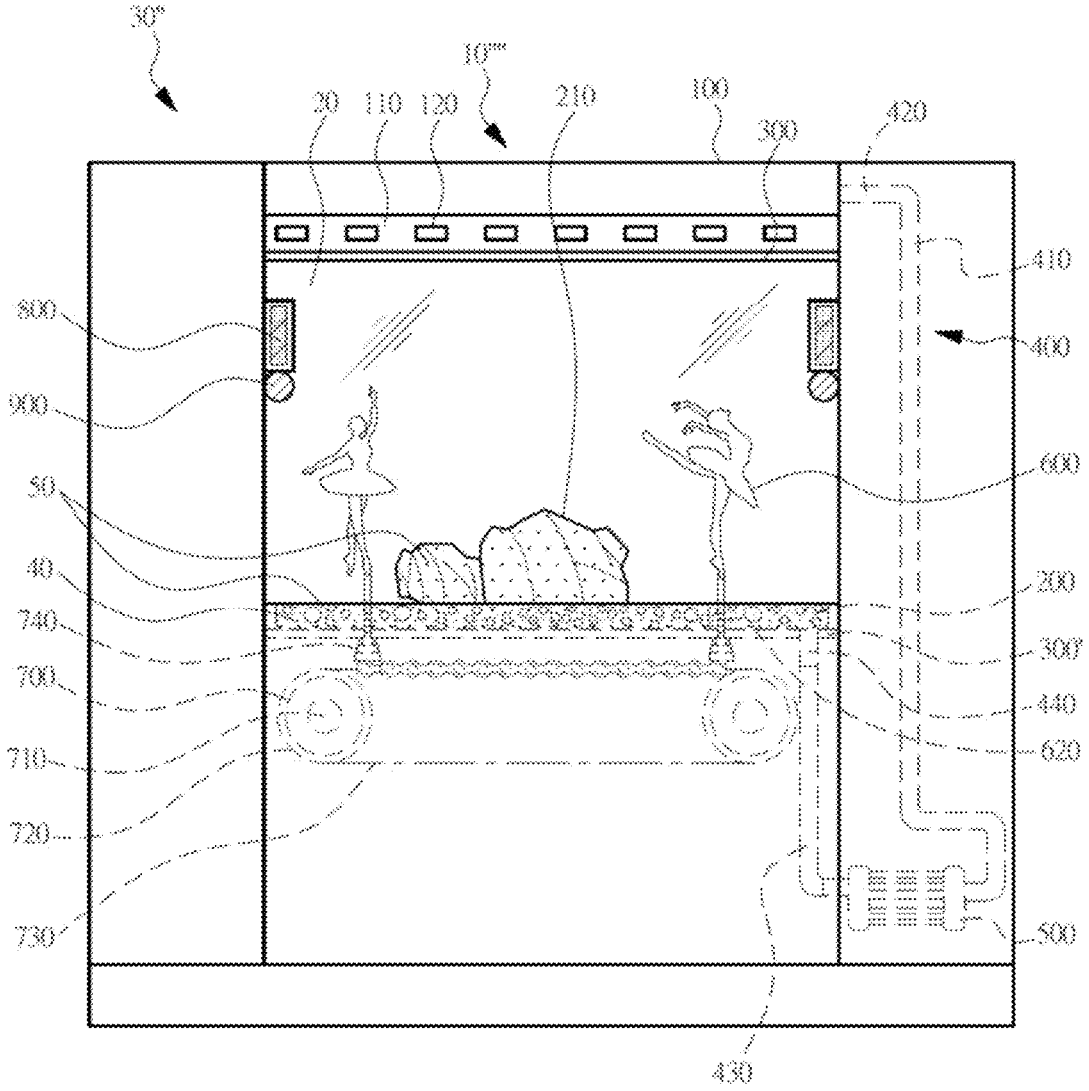
FIG. 7 is a plan schematic view of a performance room according to a further embodiment of the present disclosure.

FIG. 7 is a plan schematic view of a performance room 30" according to a further embodiment of the present disclosure. Please referring to FIGS. 3*a*, 3*b*, 6 and 7, the performance room 30" includes a device 10"" for stimulating dinoflagellates and generating a luminous effect according to the fifth embodiment of the present disclosure. The device 10"" for stimulating dinoflagellates and generating a luminous effect in the fifth embodiment is similar to the device 10''' for stimulating dinoflagellates and generating a luminous effect in the fourth embodiment, and the same elements have been designated by same reference numbers. The difference between the fourth and third embodiments is that: the water tank 100 in the fifth embodiment doesn't contain the seawater 40. In addition, the device 10"" for stimulating dinoflagellates and generating a luminous effect further includes a second switching unit 300'. The second switching unit 300' includes a plurality of switch elements 310', which are respectively disposed on a bottom of the water collecting basin 200 having a predetermined shape 210, thereby controlling the dinoflagellates 50 and the seawater 40 in the water collecting basin 200 to be disturbed.

Please referring to FIGS. 1*a*, 2*a*, 3*a*, 3*b*, 5, 6 and 7, the performance room 30, 30', 30" includes: a luminous device, an audio equipment 800, a sound sensing module 900 and a field 20 which can define a performance space. The luminous device can be the device 10", 10'", 10"" for stimulating dinoflagellates and generating a luminous effect in the third, fourth and third embodiments. And, the luminous device can also be the device 10, 10' for stimulating dinoflagellates and generating a luminous effect in the first and second embodiments. The audio equipment is adapted for providing a piece of music, wherein the music is integrated with the luminous predetermined shape 210 (i.e., the luminous effect of the dinoflagellates). The dinoflagellates 50 will follow different types of music. For example, when the music is fast-dancing music (e.g., rock music), the switch elements 310 will make the dinoflagellates 50 and/or the seawater 40 flow out with faster flow rate; and when the music is slow-dancing music (e.g., soul music), the switch elements 310 will make the dinoflagellates 50 and/or the seawater 40 flow out with slower flow rate, whereby the dinoflagellates 50 will generate luminous effects of different brightness in accordance with the high and low tonalities and rhythms of the music. Thus, the sequential tonalities and rhythms of the music are related to the switching of switching elements 310. By virtue of the linkage property of the switching elements 310, the dinoflagellates 50 flows down and touch the object 600 to generate a luminous effect.

The sound sensing module 900 (e.g., sound sensor) is electrically connected to the switch elements 310, 310' and adapted for sensing an external sound. When the sound sensing module 900 senses an external sound (e.g., a clap, but is not limited thereto), the sound sensing module 900 generates a signal and then transmits the signal to the first switching unit 300 and the second switching unit 300' to control the switch elements 310 to determine the time and order of the dinoflagellates 50 and seawater 40 in the accommodating space 130 of the water tank 100 to flow out through the holes 120 of the bottom partition plate 110; and, to control the switch elements 310' to disturb the dinoflagellates 50 in the water collecting basin 200 for stimulating the dinoflagellates 50 to generate a luminous effect. Thus, by integrating the external sound with the first switching unit 300 and the second switching unit 300', the signals of the external sound are transmitted and converted into electronic signals to control the operating functions of the switch elements 310, 310', whereby the dinoflagellates 50 generate a luminous effect, and the sequential tonalities and rhythms of the sound are related to the switching of switching elements 310, 310'. For example, after receiving the sound of "Clap", the luminous effect of the dinoflagellates 50 will correspond to the luminous word of "Thanks" or "Encore". For another example, after receiving the sound of "Married Me", the luminous effect of the dinoflagellates 50 will correspond to the luminous shape of "heart shape (i.e., the predetermined shape)".

The field 20 can define a performance space, wherein the luminous effect of the dinoflagellates 50, the music and the sound are located in the field 20 of the performance space. In this embodiment, the audio equipment 800 and the sound sensing module 900 are disposed in the field 20 of the performance space. In other embodiment, the audio equipment 800 and the sound sensing module 900 can be also disposed outside the field 20 of the performance space.

Please referring to FIG. 5 again, the performance room 30 includes: a luminous device, audio equipment 800, a sound sensing module 900 and a field 20 which can define a performance space. The luminous device can be the device 10" for stimulating dinoflagellates and generating a luminous effect in the third embodiment, and the luminous device can also be the device 10, 10' for stimulating dinoflagellates and generating a luminous effect in the first and second embodiments.

Please referring to FIG. 6 again, the performance room 30' includes: a luminous device, audio equipment 800, a sound sensing module 900 and a field 20 which can define a performance space. The luminous device can be the device 10'" for stimulating dinoflagellates and generating a luminous effect in the fourth embodiment, and the luminous device can also be the device 10, 10' for stimulating dinoflagellates and generating a luminous effect in the first and second embodiments.

Please referring to FIG. 7 again, the performance room 30" includes: a luminous device, audio equipment 800, a sound sensing module 900 and a field 20 which can define a performance space. The luminous device can be the device 10'" for stimulating dinoflagellates and generating a luminous effect in the third embodiment, and the luminous device can also be the device 10, 10' for stimulating dinoflagellates and generating a luminous effect in the first and second embodiments.

Furthermore, in other embodiment, the performance room 30', 30", 30'" doesn't include: a sound sensing module 900 disposed therein, and only includes: a luminous device, audio equipment 800 and a field 20 which can define a performance space. The luminous device can also be the device 10, 10', 10", 10'", 10"" for stimulating dinoflagellates and generating a luminous effect in the first to fifth embodiments.

In addition, in other embodiment, the performance room 30', 30", 30'" doesn't include: audio equipment 800 disposed therein, and only includes: a luminous device, a sound sensing module 900 and a field 20 which can define a performance space. The luminous device can also be the device 10, 10', 10", 10'", 10"" for stimulating dinoflagellates and generating a luminous effect in the first to fifth embodiments.

As mentioned above, the luminous device disclosed in the present disclosure generates a luminous effect by stimulating dinoflagellates. The luminous effect can be controlled and located on a specific local region of the water collecting basin according to time and order, and the luminous effect can be integrated with the music or the external sound, to enhance the visual effect of live performance of the performance room. In particularly, the luminous effect is exhibited by integrating the musical melody or the external sound with the dinoflagellates (e.g., *Noctiluca scintillans*) itself acted as a performer.

The above merely describes implementations or embodiments of technical means employed by the present disclosure to solve the technical problems, which are not intended to limit the patent implementation scope of the present disclosure. Equivalent changes and modifications in line with the meaning of the patent scope of the present disclosure or made according to the scope of the invention patent are all encompassed in the patent scope of the present disclosure.

What is claimed is:

1. A device for stimulating dinoflagellates and generating a luminous effect, comprising:

a water tank comprising a bottom partition plate and an accommodating space, wherein the bottom partition plate has a plurality of holes, and the holes are communicated with the accommodating space, and the accommodating space contains dinoflagellates and the seawater;

a first switching unit comprising a plurality of switch elements, wherein the switching elements are physically connected to the holes of the bottom partition plate respectively, and are adapted to control the flow rate of the dinoflagellates and the seawater located in the accommodating space of the water tank to flow out through the holes of the bottom partition plate; and a water collecting basin having a predetermined shape and arranged below the bottom partition plate of the water tank, whereby the dinoflagellates and the seawater flowing out from the holes of the bottom partition plate drop into the predetermined shape of the water collection basin for stimulating the dinoflagellates to generate a luminous effect, the luminous effect being located on a first region of the collection basin.

2. The device for stimulating dinoflagellates and generating a luminous effect according to claim 1, wherein the dinoflagellates are selected from *Noctiluca scintillans*.

3. The device for stimulating dinoflagellates and generating a luminous effect according to claim 1, wherein the holes of the bottom partition plate has different sizes to determine different flow rates.

4. The device for stimulating dinoflagellates and generating a luminous effect according to claim 1, further comprising: a water pipe unit having an inlet pipe and a drain pipe, wherein the inlet pipe is communicated with the water tank, and the drain pipe is communicated with the water collecting basin; and a pump disposed between the drain pipe and the inlet pipe for transporting the dinoflagellates and the seawater to the water tank.

5. The device for stimulating dinoflagellates and generating a luminous effect according to claim 1, further comprising: at least one object detachably mounted on the predetermined shape of the water collecting basin; and at least one driving unit adapted to drive the object to move on the predetermined shape.

6. The device for stimulating dinoflagellates and generating a luminous effect according to claim 5, wherein the driving unit comprises a driving element, a plurality of driving wheels driven by the driving element, a flexible chain wound around the driving wheels, and at least one fixing seat provided on the flexible chain.

7. The device for stimulating dinoflagellates and generating a luminous effect according to claim 6, wherein the driving unit further comprises a thread portion which is screwed into a screw hole, the thread portion is mounted on the fixing seat, and the object is detachably mounted on the thread portion.

8. The device for stimulating dinoflagellates and generating a luminous effect according to claim 1, wherein the first switching unit further comprises a programmable controller electrically connected to the switch elements for controlling the time and order of the dinoflagellates or seawater in the accommodating space of the water tank to flow out through the holes of the bottom partition plate.

9. The device for stimulating dinoflagellates and generating a luminous effect according to claim 1, wherein the switch element of the first switching unit is a solenoid valve or a micro valve.

10. The device for stimulating dinoflagellates and generating a luminous effect according to claim 1, wherein the water collecting basin contains the dinoflagellates which have not been stimulated yet and the seawater.

11. The device for stimulating dinoflagellates and generating a luminous effect according to claim 10, further comprising:

a second switching unit comprising a plurality of switch elements, which are respectively disposed on a bottom of the water collecting basin having a predetermined shape, thereby controlling the dinoflagellates and the seawater in the water collecting basin to be disturbed to stimulate the dinoflagellates and then to generate a luminous effect, wherein the luminous effect is located on a second region of the water collecting basin, and the second region is different from the first region.

12. A device for stimulating dinoflagellates and generating a luminous effect, comprising:

a water tank comprising a bottom partition plate and an accommodating space, wherein the bottom partition plate has a plurality of holes, and the holes are communicated with the accommodating space, and the accommodating space contains seawater;

a first switching unit comprising a plurality of switch elements, wherein the switching elements are physically connected to the holes of the bottom partition plate respectively, and are adapted to control the flow rate of the seawater located in the accommodating space of the water tank to flow out through the holes of the bottom partition plate; and a water collecting basin having a predetermined shape and arranged below the bottom partition plate of the water tank, wherein the water collecting basin contains dinoflagellates which have not been stimulated yet and seawater, whereby when the seawater flowing out from the holes of the bottom partition plate touches the dinoflagellates, the dinoflagellates are stimulated to generate a luminous effect, the luminous effect being located on a first region of the collection basin.

13. The device for stimulating dinoflagellates and generating a luminous effect according to claim 12, wherein the dinoflagellates are selected from *Noctiluca scintillans*.

14. The device for stimulating dinoflagellates and generating a luminous effect according to claim 12, further comprising:

a second switching unit comprising a plurality of switch elements, which are respectively disposed on a bottom of the water collecting basin having a predetermined shape, thereby controlling the dinoflagellates and seawater in the water collecting basin to be disturbed to stimulate the dinoflagellates and then to generate a luminous effect, wherein the luminous effect is located on a second region of the water collecting basin, and the second region is different from the first region.

15. A performance room, comprising:

a luminous device, being a device for stimulating dinoflagellates and generating a luminous effect according to claim 1;

an audio equipment electrically connected to the switch elements and adapted for providing a piece of music, wherein the music is integrated with the luminous effect of the Dinoflagellates, and the sequential tonalities and rhythms of the music are related to the switching of the switch elements; and a field defining a performance space, wherein the luminous effect of the Dinoflagellates and the music are located in the field of the performance space.

16. The performance room according to claim 15, further comprising:

a sound sensing module electrically connected to the switch elements and adapted for sensing an external sound, wherein the external sound is integrated with the luminous effect of the Dinoflagellates, and the sequential tonalities and rhythms of the sound are related to the switching of the switch elements.

* * * * *